US005769153A

United States Patent [19]

Ayers

[11] Patent Number: 5,769,153

[45] Date of Patent: Jun. 23, 1998

[54] METHOD AND APPARATUS FOR CASTING THIN-WALLED HONEYCOMB STRUCTURES

[75] Inventor: Jack D. Ayers, Oakton, Va.

[73] Assignee: The United States of America as represented by the Secretary of the Navy, Washington, D.C.

[21] Appl. No.: 745,169

[22] Filed: Nov. 7, 1996

[51] Int. Cl.[6] ..... B22D 11/06; B22D 29/04

[52] U.S. Cl. ..... 164/479; 164/131; 164/404

[58] Field of Search ..... 164/479, 429, 164/136, 131, 132, 404; 264/166, 214, 334, 336; 425/256, 443, 447

[56] References Cited

U.S. PATENT DOCUMENTS

| | | | |
|---|---|---|---|
| 2,210,145 | 8/1940 | De Bats | 164/429 |
| 3,354,937 | 11/1967 | Jackson, Jr. | 164/479 |
| 4,285,386 | 8/1981 | Narasimhan | 164/429 |
| 5,466,415 | 11/1995 | Brundage et al. | 419/67 |
| 5,498,462 | 3/1996 | Darfler | 428/116 |
| 5,514,347 | 5/1996 | Ohashi et al. | 422/174 |
| 5,533,167 | 7/1996 | Kondo et al. | 392/485 |
| 5,556,565 | 9/1996 | Kirkwood et al. | 219/633 |

*Primary Examiner*—Kuang Y. Lin

*Attorney, Agent, or Firm*—Thomas E. McDonnell; John J. Karasek

[57] ABSTRACT

The present invention is a process for making a honeycomb structure of a selected material, having the steps: (a) disposing molten material in a melt container disposed over a mold, where the melt container has an opening for releasing molten material into the mold, where the mold is shaped for molding the honeycomb structure; (b) moving the melt container relative to the mold, where the molten material flows out of the opening into the mold; and (c) removing the mold from the material. Another aspect of the invention is an apparatus for making a honeycomb structure of a selected material, including: (a) a mold shaped for molding the honeycomb structure; (b) a melt container, disposed over the mold, having an opening for releasing molten material into the mold; and (c) a conveyor, for moving the melt container relative to the mold as the melt container releases the molten material into the mold.

14 Claims, 6 Drawing Sheets

METHOD AND APPARATUS FOR CASTING THIN-WALLED HONEYCOMB STRUCTURES

BACKGROUND OF THE INVENTION

1. Field of the Invention

The present invention relates to an improved method and apparatus for making honeycombs, including metal honeycombs. More particularly, the present invention relates to casting honeycombs with a movable melt container and an "egg-carton" shaped mold.

2. Description of the Related Art

Honeycomb structures are panels with a plurality of internal voids. One of the most useful types of honeycomb structures are panels with webbing that is perpendicular to the top and/or bottom surfaces of the panel. Honeycombs of this type of have high stiffness/weight ratios, which makes them ideal for applications where this property is critical, such as in airborne or spaceborne systems.

A number of methods have been used to make metal honeycombs from sheet metal. Referring to FIG. 1, this shows a typical sheet metal precursor 10 used for making honeycombs. This precursor 10 has a number of stacked thin metal sheets 12 with staggered connections 14 between them. These connections 14 may be adhesives, welds, brazes, rivets, or other known connectors for sheet metal. By exerting an outward force as indicated by the arrows, the thin metal sheets are bent to form a webbing 20, as shown in FIG. 2. One or more top sheets, and optionally one or more bottom sheets, may then be attached to this webbing, in the plane of the drawing page, to form a honeycomb.

This method has the disadvantages of requiring a large number of process steps, and difficulty in producing uniform webbings, since even slight deviations or defects in either the metal sheets 10 or their connections 14 may lead to large defects in the resulting webbing 20.

Another method for making metal honeycombs is depicted in FIGS. 3, 4 and 5. Referring to FIG. 3, flat sections of sheet metal 12 may be bent (as shown in FIG. 4) and connected with a connector 14 (as shown in FIG. 5) to form a webbing 22. One or more top sheets, and optionally one or more bottom sheets, may then be attached to this webbing, in the plane of the drawing page, to form a honeycomb. Although this method should produce more uniform webbings than the process described above, this method will require even more process steps than the process described above, since this process requires each sheet to be individually stamped out or roll formed.

Moreover, both of these methods produce honeycombs where the cross-section of the webbing does not have the correct shape for optimal stiffness. Referring to FIG. 6, this shows the cross-section of a typical I-beam 16. An I-beam is thinnest at its midpoint 18 and thickest at the top 19 and bottom 21. When a bending load is applied to an I-beam, the maximum stresses will be at the top 19 and bottom 21, and the minimum stress will be at the midpoint 18. For example, if an I-beam is supported at the ends, and subjected to a load at the center, the top half of the beam will be under compression (maximized at the top of the beam 19), and the bottom half of the beam will be under tension (maximized at the bottom of the beam 21). At the center 18, stress will be minimal, and in theory at least there is a plane of zero stress running through the beam. Accordingly, an I-beam has an optimal cross-sectional shape for supporting a bending load, since it is thickest where the stresses are highest, and thinnest where the stresses are lowest, with a tapered transition between these sections. However, the webbings of the prior art made by the methods described above do not have an optimal cross-sectional shape, because these methods use sheet metal of uniform cross-section.

Casting methods for making metal honeycombs are also known. Existing casting techniques include die casting, investment casting, and sand casting. Die casting has the disadvantage of being small scale. Investment casting has the disadvantage of sacrificing a precision, nonreusable mold with each batch. Sand-casting, which entails the use of relatively thick sand molds, is relatively imprecise and limited to larger webbings.

Moreover, all of these methods require the fabrication of sprues and risers to deliver melt to the mold. There can also be problems in filling the entire mold without premature freezing of the melt preventing complete filling of the mold.

SUMMARY OF THE INVENTION

Accordingly, it is an object of this invention to provide honeycomb structures with a cross-section that is consistent with high stiffness.

It is a further object of this invention to provide large, high resolution honeycomb structures.

It is a further object of this invention to make honeycomb structures with reusable molds.

It is a further object of this invention to make cast honeycomb structures without the need for sprues and/or risers.

It is a further object of this invention to make honeycomb structures with a reduced number of process steps.

These and additional objects of the invention are accomplished by the structures and processes hereinafter described.

The present invention is a process for making a honeycomb structure of a selected material, having the steps: (a) disposing molten material in a melt container disposed over a mold, where the melt container has an opening for releasing molten material into the mold, where the mold is shaped for molding the honeycomb structure; (b) moving the melt container relative to the mold, where the molten material flows out of the opening into the mold; and (c) removing the mold from the material. Another aspect of the invention is an apparatus for making a honeycomb structure of a selected material, including: (a) a mold shaped for molding the honeycomb structure; (b) a melt container. disposed over the mold, having an opening for releasing molten material into the mold; and (c) a conveyor, for moving the melt container relative to the mold as the melt container releases the molten material into the mold.

BRIEF DESCRIPTION OF THE DRAWINGS

A more complete appreciation of the invention will be obtained readily by reference to the following Description of the Preferred Embodiments and the accompanying drawings in which like numerals in different figures represent the same structures or elements, wherein.

DETAILED DESCRIPTION OF THE PREFERRED EMBODIMENTS

Figure 1:
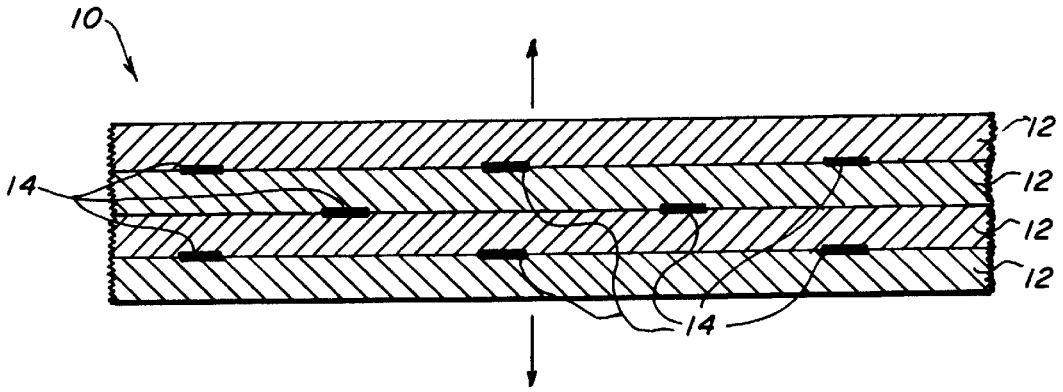
PRIOR ART FIG. 1
FIG. 1 shows a section of a honeycomb precursor according to the prior art.
Figure 2:
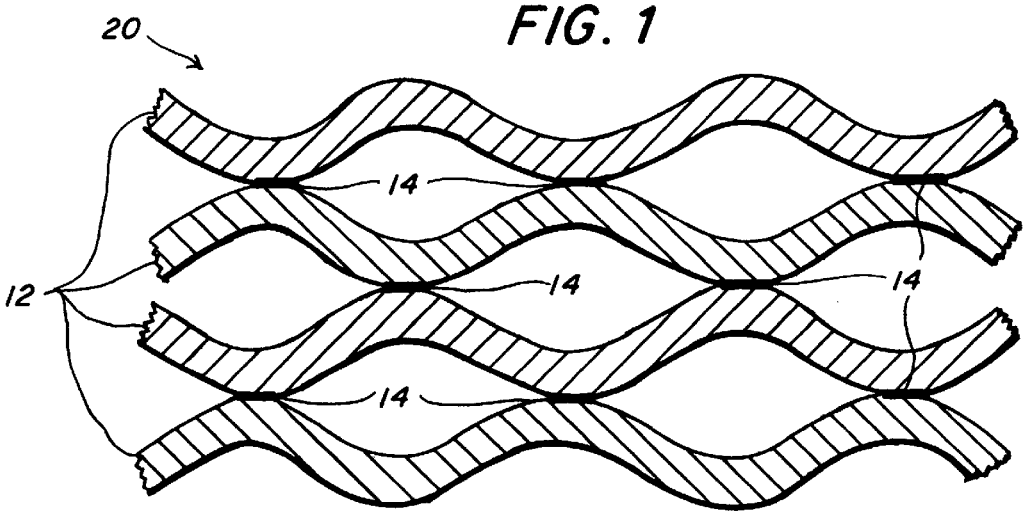
PRIOR ART FIG. 2
FIG. 2 shows a honeycomb webbing made according to the prior art.
Figure 3:
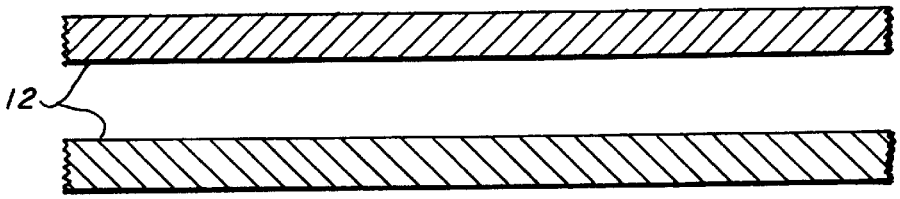
PRIOR ART FIG. 3
FIGS. 3, 4, and 5 show the steps in making a honeycomb webbing according to the prior art.
Figure 4:
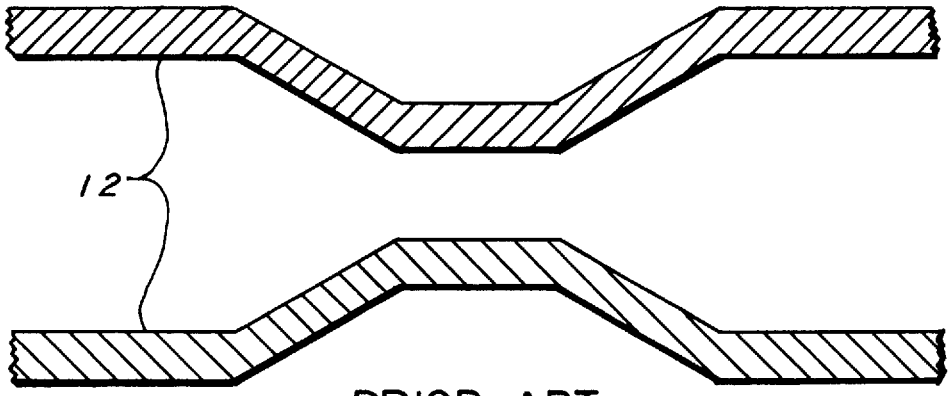
PRIOR ART FIG. 4
Figure 5:
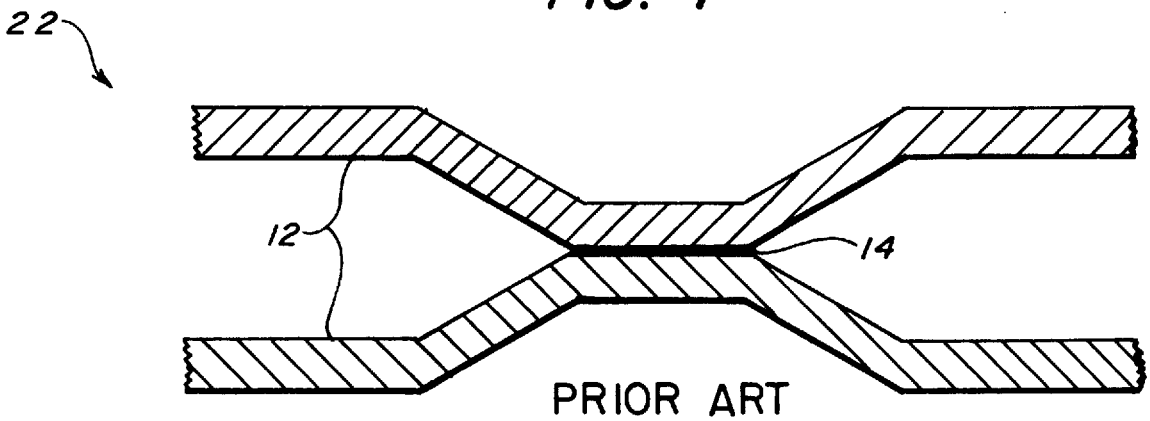
PRIOR ART FIG. 5
Figure 6:
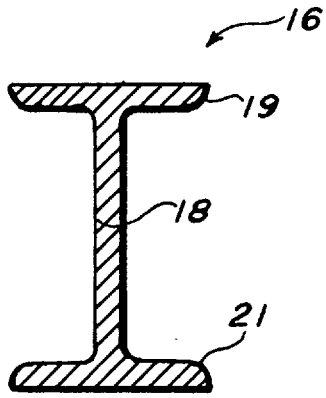
PRIOR ART FIG. 6
FIG. 6 shows a section of an I-beam according to the prior art.
Figure 7:
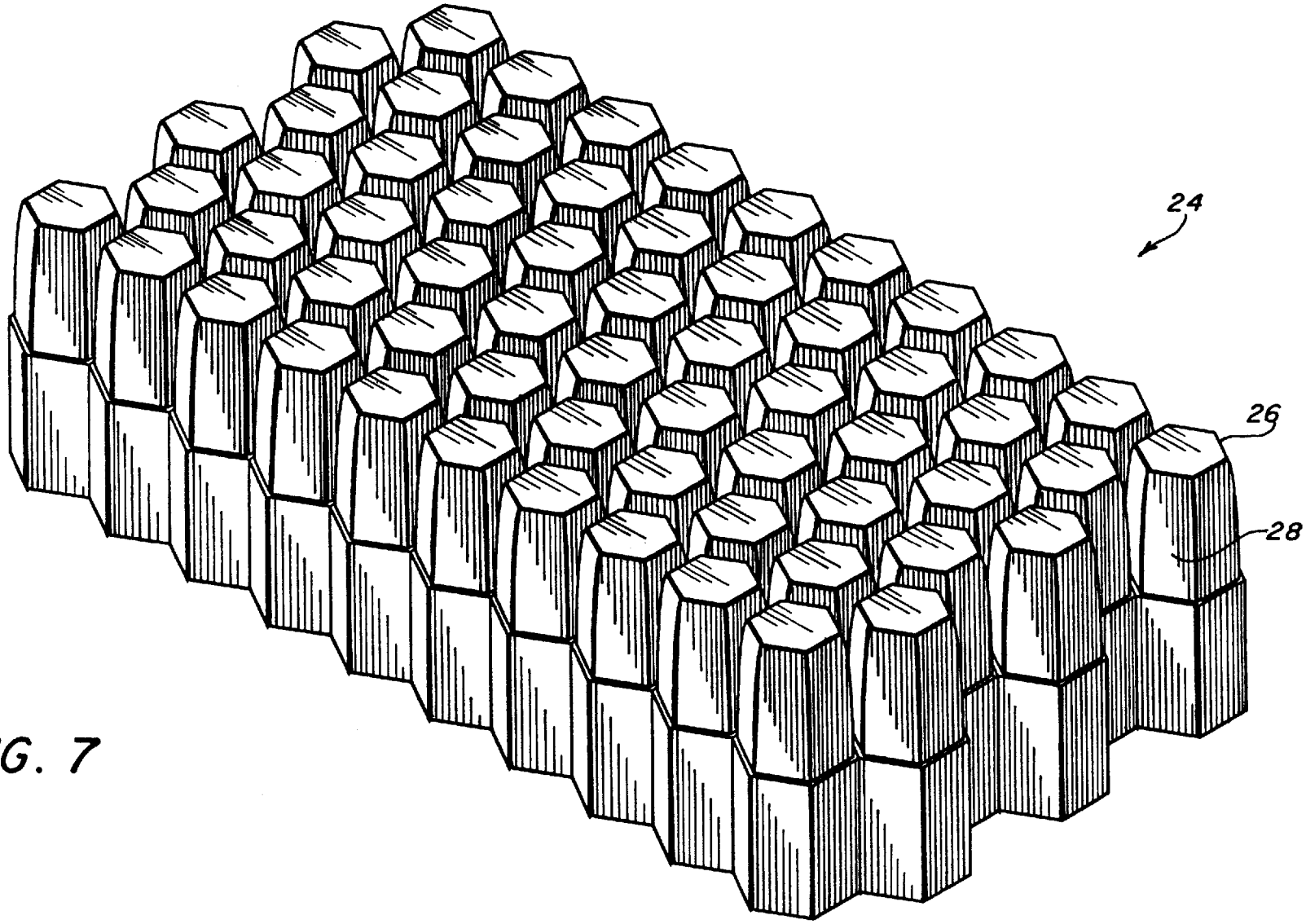
FIG. 7 is an elevation view of a preferred mold according to the present invention.

Referring to FIG. 7, a mold 24 according to the present invention includes an array of dies 26. The mold is shaped to form the desired honeycomb. Typically, these dies will be hexagonal as shown, but other shapes are acceptable: square, rectangular, triangular, etc. Preferably, the sidewalls 28 of the dies 26 have a shape that is adapted for release of the cast webbing from the mold. Preferably the die sidewalls 28 are tilted inward, away from normal so that the top of a die 26 is smaller that its base. More preferably, the die sidewalls 28 also curve outward, so that the dies 26 are convex. Most preferably, this outward curve is roughly parabolic.

Figure 8:
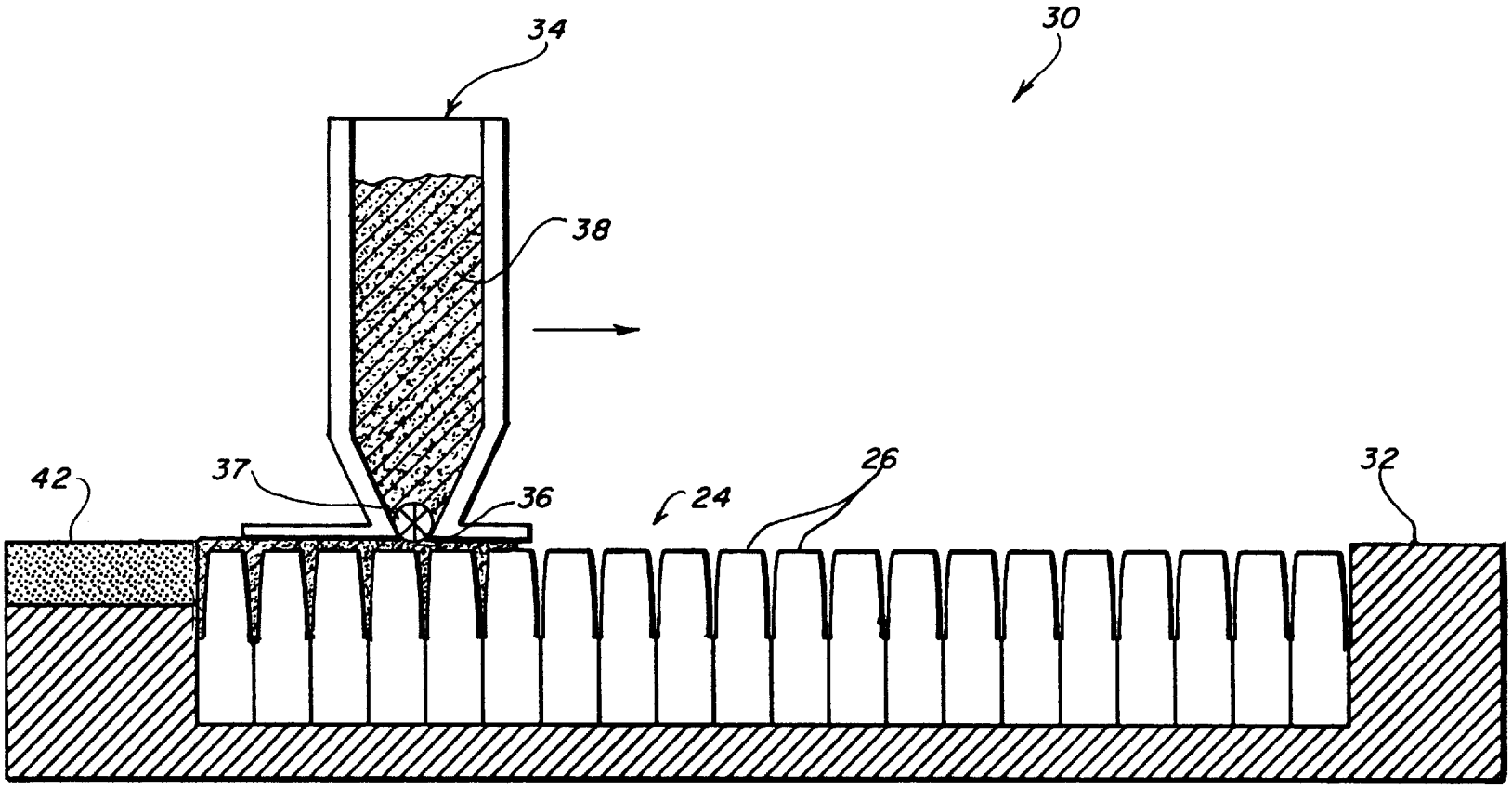
FIG. 8 is a section of an apparatus according to the invention, including a mold according to the present invention.

Referring to FIG. 8, a simple apparatus 30 according to the invention will include a mold 24, having an array of dies 26. In this embodiment of the invention, the mold is fixed in a frame 32. Over the mold 24 is a melt container 34, such as a tundish. This melt container 34 has an opening 36 for releasing molten material 38 into the mold 24. Preferably, opening 36 is controllable, i.e., it includes some type of valve 37 for keeping the melt 38 inside the melt container 34 until it is desired to start delivering the melt 38 to the mold 24. This valve 37 may be as simple as a bar that is inserted down into the melt container 34 to block the opening 36, and is retracted from the opening 36 to start the flow of the melt 38 into the mold 24. Optionally, at a first end of the frame 32 is an insulated pad 42 that serves as a starting point for the melt container 34.

In operation. the melt container 34 is positioned at one end of the mold 42, typically on insulated pad 42, and the melt container 34 is filled with molten material 38. The melt container 34 is then moved relative to the mold 24, as indicated by the arrow, allowing the molten material 38 to flow out of the opening 36 and into the mold 24. Relative motion can be achieved by moving the melt container 34 and/or the mold 24. The relative speed of the melt container 34 is selected to allow the molten material 38 to flow completely and uniformly into the mold 24, without prematurely setting up.

Preferably, the mold 24 is preheated before the molten material 38 is poured in. Preheating dries the mold 24, preventing moisture on the mold from instantly vaporizing upon contact with the molten material, creating bubbles or gaps in the finished honeycomb. Preheating will also help to prevent hot-tearing of the honeycomb webbing. Hot-tearing occurs when a newly-solidified material cools in a constrained manner so that strains develop, leading to tears in the solidified material. This frequently occurs when a molten material surrounds a much cooler solid material (such as one of the dies of the present invention), so that the newly-solidified material is cooled through a large temperature interval. Preheating helps prevent hot-tearing by limiting the degree of cooling while the casting is constrained by the dies.

However, it is preferred to not have complete uniformity in the cooling process. It is preferred that the portion of the melt in direct contact with the mold solidify first, but not so much more quickly than the rest of the melt that hot-tearing results. The reason that the portion of the melt in direct contact with the mold should solidify first is so that the dies may be removed from the partially solidified honeycomb. Extraction of the honeycomb from the dies will be aided by limiting the degree of cooling of the solid material in contact with the dies.

The preferred time for removing the dies from the cast honeycomb will depend on a number of factors. including (a) the temperature of the mold, (b) the temperature of the melt, (c) the thermal properties of the melt ($C_p$, thermal conductivity, $\Delta H_{fusion}$, etc.), (d) the thermal properties of the mold, including the thermal properties of any coatings on the mold (it will often be advantageous to coat the dies with certain non-stick coatings such as oxide coatings).

Figure 9:
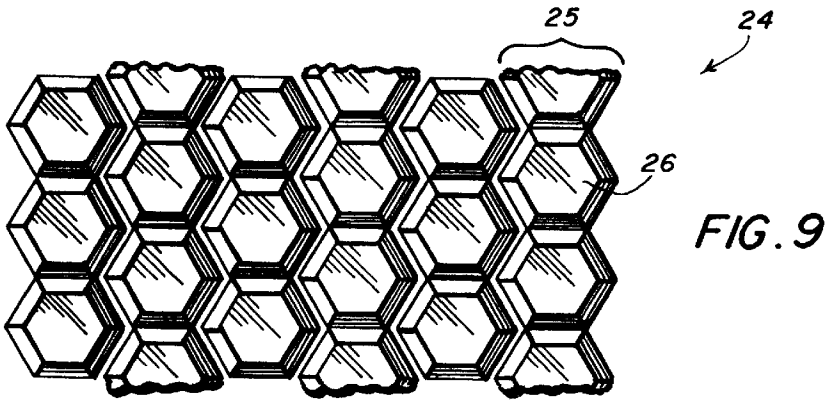
FIG. 9 is a top view of a preferred mold comprising a preferred array of dies according to the present invention.

Referring to FIG. 9, this figure is a top view of a preferred mold 24 comprising a preferred array of dies 26 according to the present invention. These dies are connected to make rows 25 of dies, where each row 25 is free to move vertically independently of the other rows.

Figure 10:
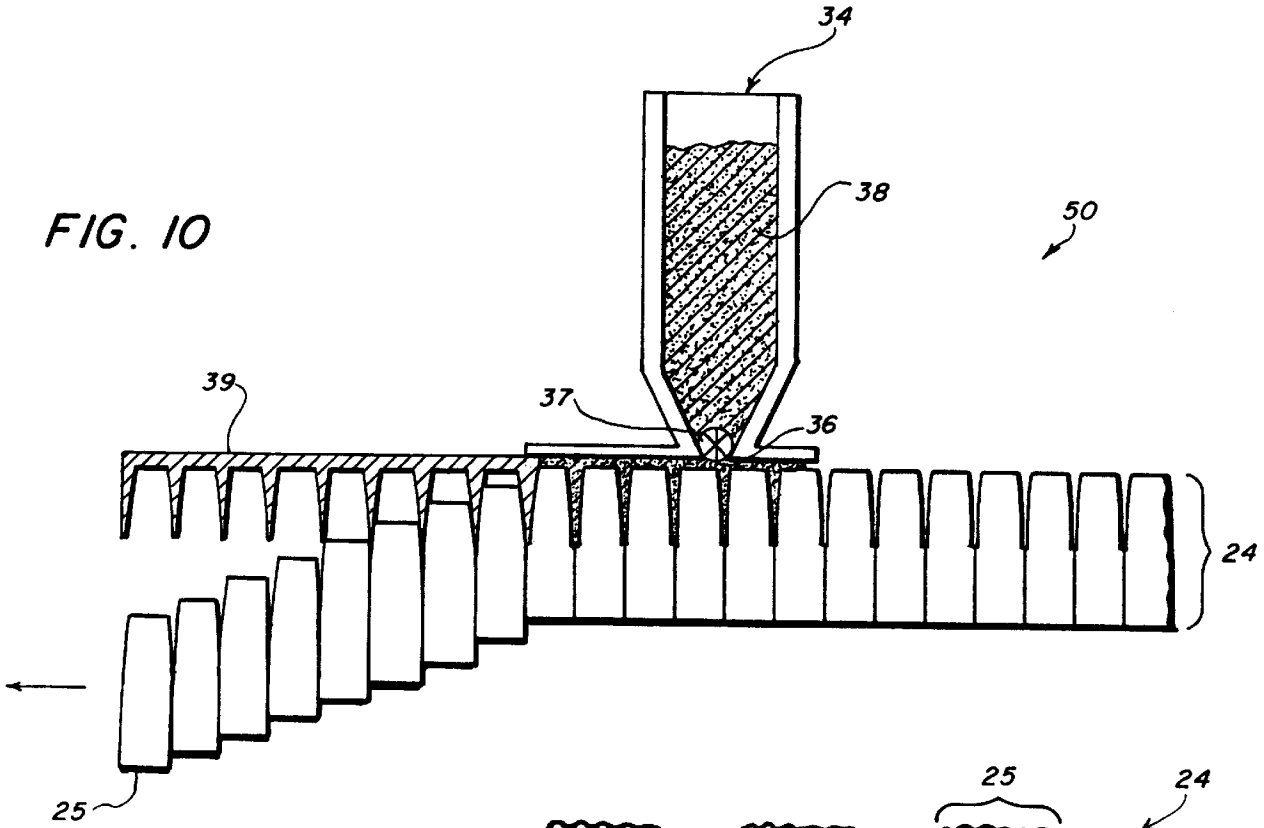
FIG. 10 is a section of another apparatus according to the invention, including a mold according to the present invention.

Referring to FIG. 10, this figure shows the mold depicted in FIG. 9 in another apparatus 50 according to the invention. This apparatus 50 includes a mold 24 having dies arranged in rows 25. Each row 25 of dies is free to move vertically. Over the mold 24 is a melt container 34, such as a tundish. This melt container 34 has an opening 36 for releasing molten material 38 into the mold 24. The opening 36 is preferably controlled by a valve 37. This apparatus 50 also includes a conveyor (not shown) for moving the mold 24 relative to the melt container 34 as indicated by the arrow, and for pulling the rows 25 of dies down away from the at least partially solidified honeycomb 39.

In operation, the melt 38 is allowed to flow into the mold 24, and the mold 24 is moved horizontally relative to the melt container 34, allowing the melt 38 to flow over each successive row 25 of dies 26. As the melt 38 flows into the mold 24, the melt begins to solidify, forming the honeycomb 39. When the cast honeycomb 39 is at a selected degree of solidification, the dies 24 are extracted from the honeycomb. As noted above, the dies 26 are preferably preheated.

The rows 25 of dies preferably will be pulled down away from the honeycomb in a manner that is consistent with the preferred cooling features described above. Preferably, the dies will be removed from the honeycomb 39 so that (1) the honeycomb is sufficiently hardened to be self-supporting, (2) hot tearing is avoided, and (3) the dies are readily removed from the honeycomb.

A wide range of methods for pulling the rows of dies down will be available. One method will entail the use of pull rods pulling down on pins extending from the sides of the rows. These pull rods will be part of the conveyor system.

The foregoing preferred embodiments of the invention entailed the use of reusable dies. However, sacrificial dies may also be used according to the present invention. Brittle, crushable dies such as ceramic dies may be used in the present invention. Likewise, low-melting dies may be used in the present invention. For example, bismuth, lead, and antimony all melt well below the melting point of aluminum and aluminum-based alloys. Thus, these metals and their alloys may be used as meltable sacrificial dies in the present invention. Alloys with specific melting points have been developed. Such alloys will be useful as dies in the present invention.

After honeycombs have been cast by the methods described above, they will be open to further processing.

Figure 11:
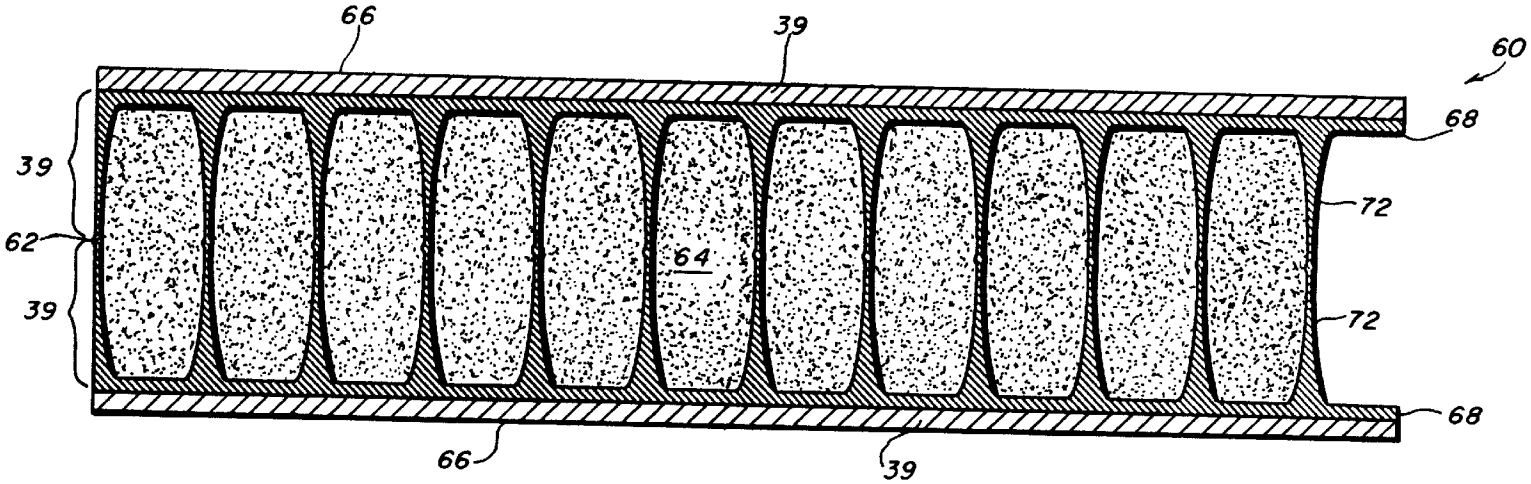
FIG. 11 is a section of a preferred cast honeycomb according to the present invention.

Referring to FIG. 11, this shows a preferred honeycomb 60 according to the present invention. This honeycomb 60 has two cast honeycomb sections 39 connected at their webbings 72 with connectors 62. Note that the webbings 72 have the preferred I-beam cross-sectional shape. Optionally, the cells between the webbing can be filled with a core material 64, such as ceramics, polymers, etc. These core materials can add desired features to the honeycomb, such as impact resistance, fire resistance, sound deadening, etc. Optionally, additional layers 66 may be added to one or both of the top sheets 68 of the cast honeycombs. These additional layers, which may be the same or different may be such things as metal, polymer, ceramic, rubber, wood, etc. These additional layers can add such features as stealth, additional strength, aesthetics, fire resistance, sound deadening, etc.

Connectors 62 can be chosen from a wide range of connectors, including welds, brazes, and adhesives. Because of the preferred profile of the webbing 72, with the webbing being thinnest at the connection point resistance welding can be used to connect the two cast honeycombs 39. Brazing and laser welding are two particularly advantageous connection techniques.

Figure 12:
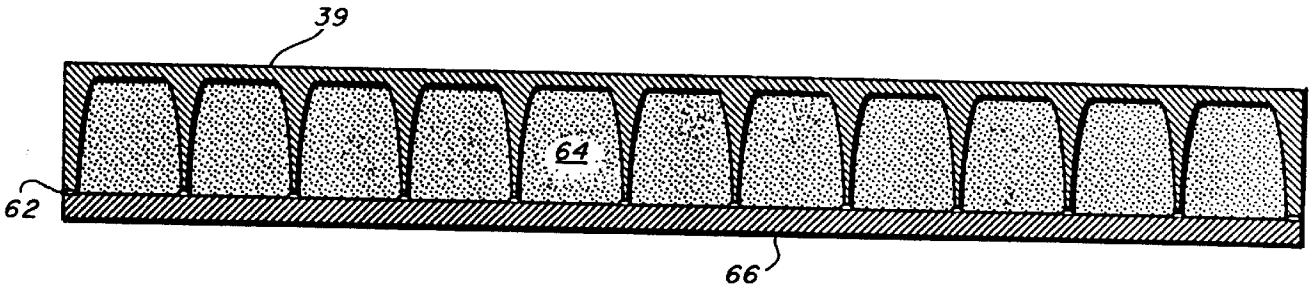
FIG. 12 is a section of another preferred cast honeycomb according to the present invention.

Referring to FIG. 12, this shows another preferred honeycomb 70 according to the present invention. In this preferred honeycomb, a high strength sheet 66 is attached to the cast honeycomb 39 with high strength connectors 62. Cells between the webbing is filled with ceramic 64. Such a composite structure may be used as low-density armor for a range of military applications.

Obviously, many modifications and variations of the present invention are possible in light of the above teachings. It is therefore to be understood that, within the scope of the appended claims, the invention may be practiced otherwise than as specifically described.

What is claimed is:

1. A process for making a honeycomb structure of a selected material, comprising the steps:

disposing molten material in a melt container disposed over a mold, wherein said melt container has an opening for releasing molten material into said mold, wherein said mold is shaped for molding said honeycomb structure, wherein said mold comprises a plurality of dies;

moving said melt container relative to said mold, wherein said molten material flows out of said opening into said mold; and removing said mold from said material wherein, said step of removing said mold from said material comprises removing said dies in a predetermined sequence, at predetermined times, wherein each of said predetermined times is at least as long as a time necessary for at least a portion of said material in contact with said die to reach a temperature wherein said material can maintain its shape after removal of said die.

2. The process of claim 1, wherein said material is a metal.

3. The process of claim 2, wherein said metal is selected from the group consisting of aluminum and alloys thereof.

4. The process of claim 1, wherein said melt container is disposed near a first end of said mold, and wherein said step of moving said melt container relative to said mold comprises moving said melt container relative to said mold to an opposing end of said mold.

5. The process of claim 1, further comprising the step of drying said mold, prior to said step of moving said melt container relative to said mold, wherein said molten metal flows out of said opening into said mold.

6. The process of claim 5, wherein said drying comprises heating said mold to a drying temperature.

7. The process of claim 1, further comprising the step of heating said mold to a temperature selected to prevent hot-tearing of said honeycomb structure.

8. The process of claim 1, wherein said mold comprises at least one die, and wherein said step of removing said mold from said material comprises removing said at least one die intact from said material at a preselected time, wherein said preselected time is at least as long as a time necessary for a portion of said material in contact with said die to reach a temperature wherein said metal can maintain its shape after removal of said die.

9. The process of claim 1, wherein said mold comprises at least one meltable die, and wherein said step of removing said mold from said material comprises melting said at least one die at a temperature below the melting point of said material.

10. The process of claim 1, wherein said mold comprises at least one brittle die, and wherein said step of removing said mold from said material comprises breaking said die.

11. The process of claim 10, wherein said brittle die comprises a ceramic, plaster, or glass die.

12. The process of claim 1, wherein said mold is shaped for molding said honeycomb structure to have a webbing and a top sheet on a top side of said webbing.

13. The process of claim 1, wherein said mold is shaped for molding said honeycomb structure to have a webbing with a tapered cross-section.

14. An apparatus for making a honeycomb structure of a selected material, comprising:

a mold shaped for molding said honeycomb structure;

a melt container, disposed over said mold, having an opening for releasing molten material into said mold; and a conveyor, for moving said melt container relative to said mold as said melt container releases said molten material into said mold;

wherein said mold comprises a plurality of dies, and wherein said conveyor is adapted for removing said dies from said material in a predetermined sequence, at predetermined times after said melt container releases said molten material into said mold, wherein each of said predetermined times is at least as long as a time necessary for a portion of material in contact with said die said to reach a temperature wherein said material can maintain its shape after the removal of said die.

* * * * *